US005494197A

United States Patent [19]

Grieves

[11] Patent Number: 5,494,197

[45] Date of Patent: Feb. 27, 1996

[54] MATERIAL HANDLING DEVICE FOR ELECTROPLATING APPLICATIONS

[75] Inventor: Gregory B. Grieves, Saranac, Mich.

[73] Assignee: Saranac Tank, Inc., Saranac, Mich.

[21] Appl. No.: 281,419

[22] Filed: Jul. 27, 1994

[51] Int. Cl.[6] ..... B67D 5/06

[52] U.S. Cl. ..... 222/181.2; 141/330; 141/340; 141/364

[58] Field of Search ..... 222/181.2, 189, 222/564, 460, 461, 572; 141/331, 333, 340–342, 363–365

[56] References Cited

U.S. PATENT DOCUMENTS

| | | | |
|---|---|---|---|
| 1,517,630 | 12/1924 | Jones | 204/287 |
| 2,524,243 | 10/1950 | Wicklund | 248/94 |
| 2,708,054 | 5/1955 | Rose et al. | 222/302 |
| 3,728,247 | 4/1973 | Haney | 204/286 |
| 3,804,136 | 4/1974 | Thomson | 141/284 |
| 4,027,787 | 6/1977 | Bibeau et al. | 222/181 |
| 4,039,104 | 8/1977 | Mijares, Jr. et al. | 222/181 |
| 4,324,623 | 4/1982 | Schaer | 204/235 |
| 4,361,254 | 11/1982 | Teraouku et al. | 141/331 |
| 4,399,019 | 8/1983 | Kruper et al. | 204/212 |
| 4,671,862 | 6/1987 | Birkle et al. | 204/213 |
| 4,828,667 | 5/1989 | Silvestri et al. | 202/255 |
| 5,080,259 | 1/1992 | Hadley | 141/364 |

*Primary Examiner*—Andres Kashnikow
*Assistant Examiner*—Philippe Dergkshani
*Attorney, Agent, or Firm*—Price, Heneveld, Cooper, DeWitt & Litton

[57] ABSTRACT

A material handling device for reducing spillage of flowable or particulate material dispensed into a storage bin, the device comprising an upper region defining a first opening for receiving such material and a pair of discharge members extending in a direction opposite the first opening. The device is particularly suited for placement over a horizontal support rod from which the bin is typically suspended from. The device finds wide use in electroplating applications providing methods of maintaining a uniform arrangement of bins in an electroplating tank, and methods of protecting hardware utilized for suspending bins from electroplating tank support rods.

25 Claims, 3 Drawing Sheets

MATERIAL HANDLING DEVICE FOR ELECTROPLATING APPLICATIONS

FIELD OF THE INVENTION

The present invention relates to a material handling device particularly adapted for facilitating the transfer of electroplating material into electroplating feed bins.

BACKGROUND OF THE INVENTION

Typical electroplating processes utilize an electroplating tank which contains numerous bins extending downward into electroplating solution in the tank. The bins are typically suspended by hooks from one or more rods which extend across an open top of the tank. The bins contain and disperse the materials to be plated via the electroplating solution and have screened bottoms to allow the electroplating solution to contact and dissolve the material. It is important to maintain a uniform and constant arrangement of bins in the tank to minimize variations in electroplating characteristics between batches or subsequent electroplating process runs. The configuration of the relatively large number of bins in a tank typically changes over a series of batches, and causes variations in both product and process specification. Thus, there is a need for a device and method of maintaining uniform spacing of bins in an electroplating tank.

As electroplating occurs, it is necessary to add additional amounts of electroplating feed material to each bin. The electroplating materials are most commonly metal particles in the form of shavings. Typically bins are filled by workers shoveling the particles into the bins. In doing such, a significant portion of the particles often do not enter the bins but instead fall into the electroplating solution. Although such particles may eventually dissolve in the solution, it is undesirable to have a source of electroplating material from a location in the tank different than the uniformly arranged bins since the electroplating process characteristics may be affected. A second problem results from build up on the bottom of the electroplating tank of particles, such as those which have missed the bin during filling by a worker. Such build up forms a mound which extends upward from the tank bottom, and often contacts parts which are dipped into the tank for electroplating. Such contact may result in an electrical short circuit and lead to excessive heating of the part to be electroplated. Thus, there is a need for a device and method which prevents or significantly reduces spillage of feed particles into the electroplating tank.

As noted, the bins are typically suspended by hooks from one or more rods which extend across the open tank top. The hooks are exposed to a wide array of caustic materials and from mechanical impacts, most commonly from above the tank rod. Examples of such impacts include hits from shovel ends when workers fill the bins, impacts from falling streams of metal particles intended for the bins, and impacts from a wide array of objects, that may by accident or otherwise, fall onto the suspending rod and hook(s). Repeated impacts of the hooks result in mechanical stress and if the hooks are not repaired or replaced, will lead to mechanical failure. Thus, there is a need for a device and method of protecting suspending hooks from impacts and from contact with caustic materials.

SUMMARY OF THE INVENTION

The present invention provides a unique and remarkable material handling device that remedies the previously noted problems. The device is particularly well suited for use with electroplating equipment and for filling electroplating bins with particulate material. The device is adapted for placement on a generally horizontal support rod, and comprises an upper region for receiving particulate material and a pair of discharge members for directing the material downward below the device. The invention further includes methods for reducing spillage of flowable or particulate material when filling a storage bin, methods of achieving and maintaining uniform spacing between adjacent bins, and methods of providing protection for suspending hooks that are typically utilized in conjunction with storage bins(s).

DESCRIPTION OF THE PREFERRED EMBODIMENT

Figure 1:
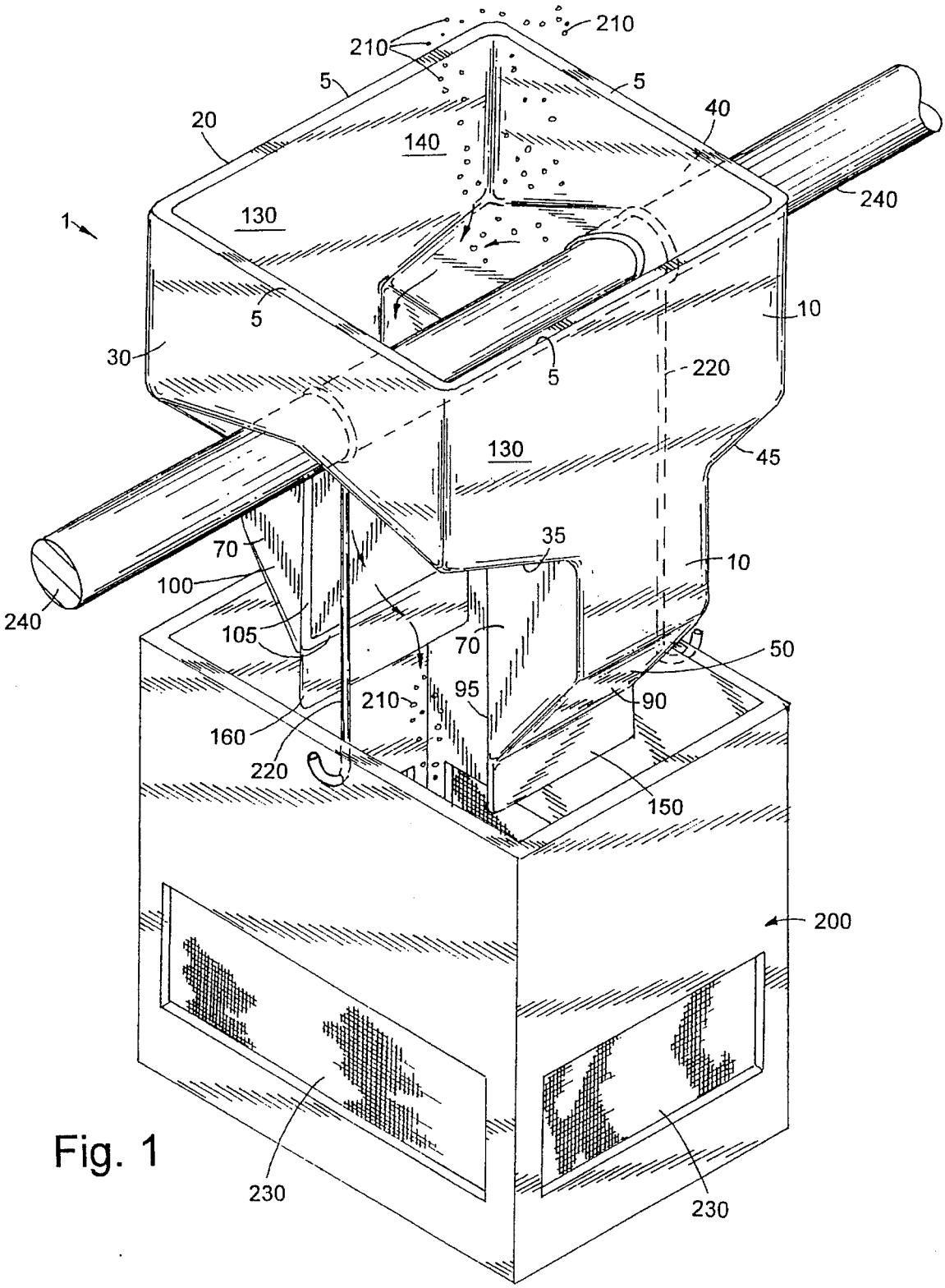
FIG. 1 is a perspective view of the material handling device of the preferred embodiment positioned on an electroplating tank support rod and disposed over an electroplating bin.

FIG. 1 illustrates a material handling device 1 of the preferred embodiment positioned over an electroplating feed bin 200 by a support rod 240. Bin 200 contains electroplating feed material 210 and when in use, is at least partially immersed in electroplating solution (not shown in FIG. 1). Bin 200 typically contains one or more screened areas 230 to allow contact between electroplating feed material 210 contained in bin 200 and electroplating solution outside the bin. Bin 200 is typically suspended from support rod 240 by a suspending device such as one or more suspending hooks 220. Device 1 facilitates the filling of bin 200 suspended from rod 240, with electroplating feed material 210. As electroplating feed material 210 is dispensed into device 1, it is efficiently directed around rod 240 and into bin 200, thereby avoiding spillage of the material outside of bin 200.

As illustrated in FIGS. 1–6, material handling device 1 of the preferred embodiment comprises an upper region having an opening defined by outer brim 5 for receiving particulate material 210 and a pair of discharge members 90, 100 extending below the upper region for directing particulate material out of the device. Discharge member 90 has an inward facing opening defined by lower slot edge 95 and upper slot edges 110 and 120. Discharge member 100 has an inward facing opening defined by lower slot edge 105 and upper slot edges 110 and 120. Extending downward from each discharge member 90 and 100, are extension walls 150 and 160, respectively.

The upper region of device 1 comprises a pair of laterally spaced, generally parallel, upper sidewalls 10, 20 and a pair of laterally spaced, generally parallel, upper endwalls 30, 40. The four walls are joined to one another along their vertical edges to form a generally rectangular chamber. The uppermost edge of the four walls constitutes upper brim 5 which also defines the opening of device 1 for receiving particulate material. In a most preferred embodiment, the opening defined by brim 5 should be as large as possible so that when the device is utilized as depicted in FIG. 1, spillage is eliminated and all electroplating feed material 210 dispensed to bin 200, enters bin 200.

Figure 3:
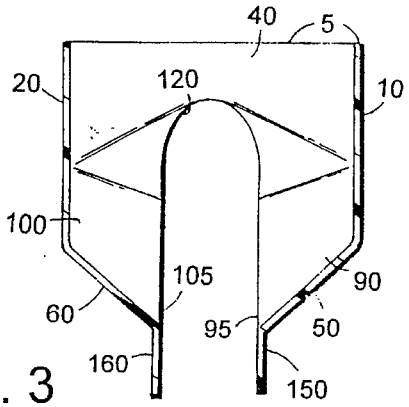
FIG. 3 is a cross section of the material handling device depicted in FIG. 2 taken across section III—III.
Figure 2:
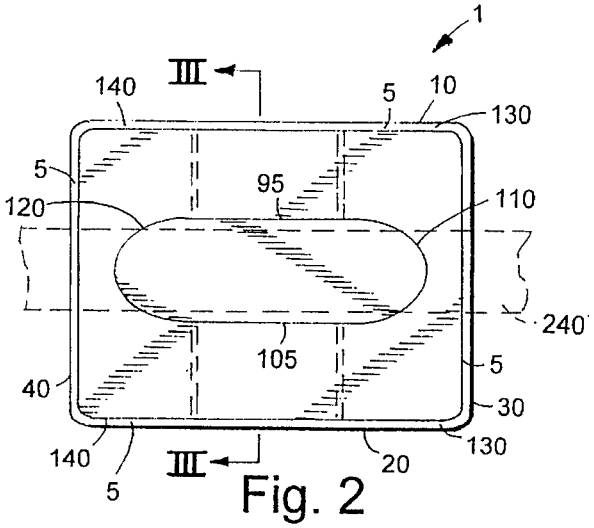
FIG. 2 is a plan view of the material handling device of the preferred embodiment.
Figure 4:
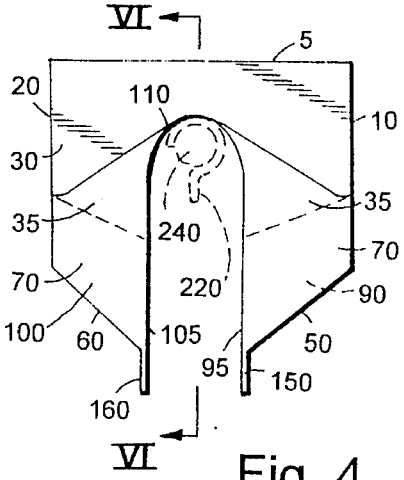
FIG. 4 is an end view of the material handling device depicted in FIG. 2.

Each member 90, 100 generally comprises two lower laterally spaced, generally parallel, endwalls separated by a lower sidewall. Specifically, discharge member 90 comprises lower endwalls 70, 80 separated by a lower sidewall 50. Sidewall 50 preferably slopes inward at an angle of about 45° from vertical as illustrated in FIGS. 3 and 4. Endwalls 70, 80 and sidewall 50 are joined to one another along their edges to form discharge member 90 which resembles a channel-like structure having a U-shaped cross section as taken along a plane parallel to the upper opening defined by brim 5. Discharge member 100 comprises lower endwalls 70, 80 separated by a lower sidewall 60. Similarly, sidewall 60 preferably slopes inward at an angle of about 45° from vertical. Endwalls 70, 80 and sidewall 60 are joined to one another along their edges to form member 100 which resembles a channel-like structure having a U-shaped cross section as taken along a plane parallel to the upper opening defined by brim 5.

When particulate material is dispensed into device 1, the sloping configuration of lower sidewalls 50 and 60 tends to direct flowing particulate material into a common single stream of material exiting device 1. This is desirable when device 1 is utilized as in FIG. 1 so that when electroplating feed material is added to bin 200 via device 1, spillage of material away from bin 200 is reduced or eliminated. It is envisioned that a variety of other configurations could be utilized for lower sidewalls 50, 60, and for the lower portions of discharge members 90, 100. That is, instead of planar, inward sloping surfaces for sidewalls 50, 60, discharge members 90, 100 could be formed to have a generally curved shape which also would direct flowing particulate material into a single, common stream.

In the most preferred embodiment, each discharge member contains an extension wall that further directs flowing particulate material into a single, common stream. Each extension wall is preferably joined or formed along the distal portion of lower slot edge 95 or 105, and generally extends in a direction opposite the upper opening of device 1. Extension wall 150, as depicted in FIG. 1, extends downward from discharge member 90 a distance sufficient to reflect and/or redirect particulate material that exits discharge member 100 at a relatively high velocity, that would otherwise not form part of the single, common stream of particulate material flowing from device 1, if not redirected by wall 150. Similarly, extension wall 160 extends downward from discharge member 100 a distance sufficient to redirect particulate material that exits discharge member 90, that would otherwise not form part of the single, common stream of particulate material flowing from device 1. Each extension wall 150 and 160 is preferably planar and has a smooth surface finish at least on the inward facing surfaces. The material of construction and thickness of each wall is preferably the same as utilized for the other walls of device 1 as described in greater detail below.

The uppermost regions of lower sidewalls 50, 60 are contiguous with lower portions of upper sidewalls 10, 20. That is, lower sidewall 50 forms a continuous outer surface with a lower portion of upper sidewall 10. Similarly, lower sidewall 60 forms a continuous outer surface with a lower portion of upper sidewall 20. With regard to the ends of the material handling device, medial sloped endwall 35 is disposed between and joins upper endwall 30 and lower endwall 70. Similarly, medial sloped endwall 45 is disposed between and joins upper endwall 40 and lower endwall 80. In a most preferred embodiment, medial sloped endwalls 35 and 45 slope inward toward the interior of the device as they extend downward from upper endwalls 30, 40 at an angle of about 45° from vertical.

Device 1 further defines at least one slot, and preferably a pair of slots, generally formed between discharge members 90 and 100, for receiving and accommodating support rod 240. The slot formed in lower endwall 70 and medial sloped endwall 35 and generally defined by upper slot edge 110 and the vertical portions of lower slot edge 105 and lower slot edge 95, should have sufficient width and length dimensions to receive and accommodate tank support rod 240. Similarly, the slot formed in lower endwall 80 and medial sloped endwall 45 and generally defined by upper slot edge 120 and the vertical portions of lower slot edge 105 and lower slot edge 95, should have sufficient width and length dimensions to receive and accommodate tank support rod 240. Preferably, both upper slot edges 110 and 120 have a curvature comparable to the outer shape of support rod 240. Generally, since most such support rods are cylindrical, it is preferred that upper edges 110 and 120 have a circular curvature. However, it is clearly envisioned that a wide array of configurations may be utilized for edges 110 and 120 depending upon the configuration of the support rod(s).

Figure 6:
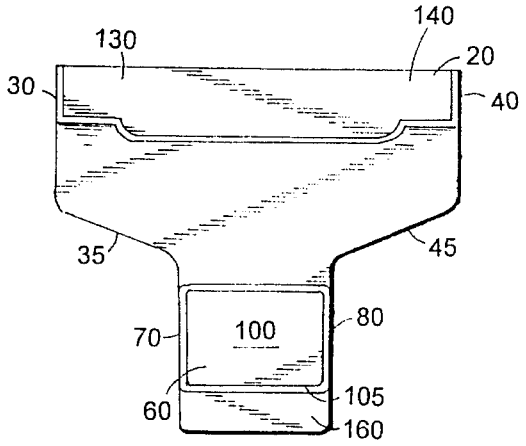
FIG. 6 is a cross section of the material handling device of FIG. 4 taken across section VI—VI.
Figure 5:
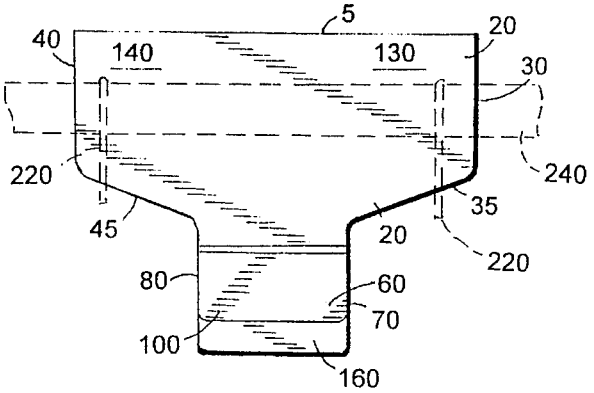
FIG. 5 is an elevational view of the material handling device depicted in FIG. 2.

FIGS. 1, 5, and 6 illustrate a feature of the preferred embodiment comprising shoulders 130, 140 disposed on each end of device 1. The shoulders provide protection for suspending hooks 220 over a portion of their length from lateral impacts, impacts from above, or contact with caustic materials. The shoulders result from upper sidewalls 10, 20 having a greater length than the length of lower sidewalls 50, 60 and the configuration of upper sidewalls to lower sidewalls. That is, shoulder 130 generally comprises the lateral portions of upper sidewalls 10, 20 proximate endwall 30. Similarly, shoulder 140 generally comprises the lateral portions of upper sidewalls 10, 20 proximate endwall 40. The shoulders extend outward from each end of device 1 along support rod 240 a distance sufficient to partially cover suspending hooks 220 which are typically positioned relative to device 1 as shown in FIGS. 1 and 5. This feature provides a method for protecting at least a portion of suspending hooks or other suspending devices from impacts or contact with caustic materials by positioning device 1 over a suspended bin as shown in FIG. 1.

Figure 7:
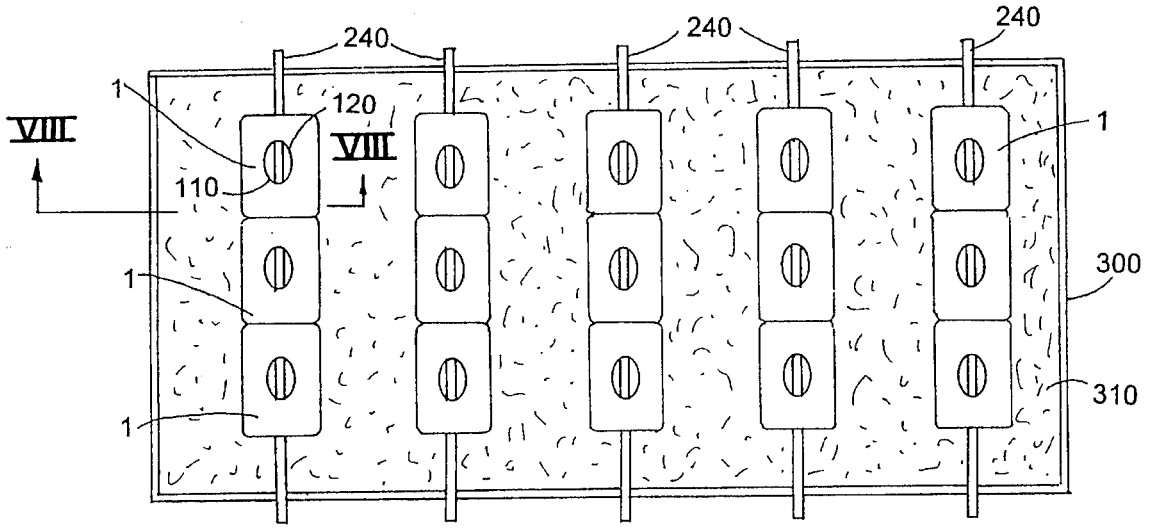
FIG. 7 is a plan view of an electroplating tank containing a plurality of material handling devices of the preferred embodiment disposed on several electroplating tank support rods extending across the tank.
Figure 8:
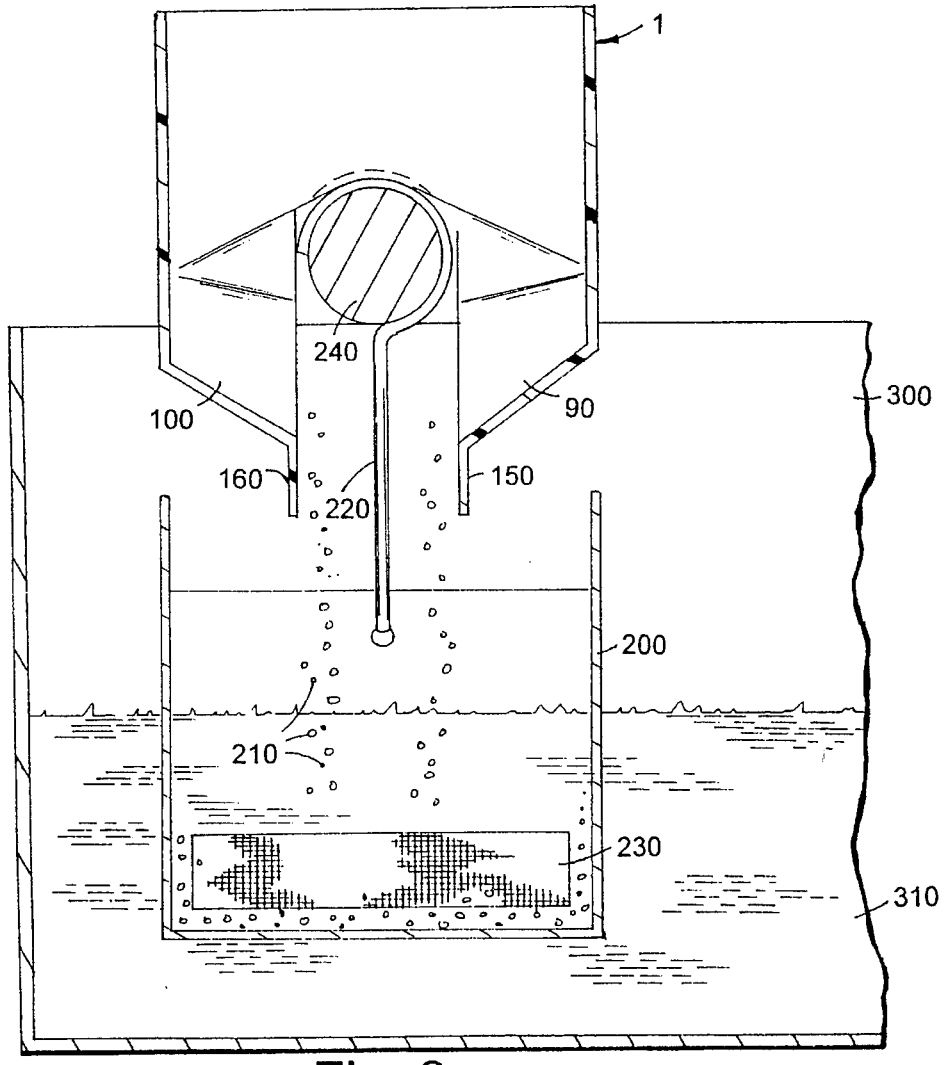
FIG. 8 is a fragmented end view taken across section VIII—VIII in FIG. 7 of the material handling device positioned on an electroplating tank support rod and disposed over an electroplating bin partially immersed in electroplating solution.

As was noted under the Background of the Invention, it is desirable to maintain a uniform and constant arrangement of bins in an electroplating tank to minimize variations in electroplating characteristics between batches. The shoulders formed on each end of device 1 also effectively serve as spacing means when a plurality of devices 1 are used with a plurality of bins 200 as illustrated in FIG. 7. FIG. 7 is a plan view of an electroplating tank 300 containing electroplating solution 310 and having a plurality of support rods 240 extending across the tank. From each rod 240 are suspended one or more bins 200 (not shown in FIG. 7) containing electroplating feed material 210 (not shown in FIG. 7). FIG. 8 illustrates typical use and placement of device 1 in an electroplating assembly comprising a bin 200 suspended from a support rod 240 by one or more hooks 220, such that device 1 is disposed directly above bin 200. This relationship of device 1 and bin 200 is such that the placement and position of a bin relative to rod 240 is typically governed by the position of device 1 on rod 240.

In applications utilizing a plurality of bins 200, such as depicted in FIG. 7, it is desirable to use a plurality of devices 1 and position adjacent devices so that their ends contact one another. Thus, by achieving and maintaining a uniform configuration of devices 1, a uniform configuration is maintained between bins 200 over the course of subsequent electroplating operations. It is envisioned that one or more spacers could be utilized at one or both ends of the collection of devices disposed along a rod to prevent the entire collection from sliding or otherwise changing position along the rod.

Device 1, as has been previously noted, is particularly useful for reducing spillage or waste or material being dispensed into a storage bin that is suspended from a support rod. Such waste or spillage can be significantly minimized or even eliminated by positioning device 1 of the preferred embodiment on a support rod, generally over the storage bin to be filled. After ensuring that the discharge members of device 1 are directed toward the bin to be filled, material may be dispensed into device 1.

It has been noted herein that device 1 is adapted for placement on a generally horizontal rod such as rod 240. Therefore, in the preferred embodiment, the center of mass of device 1 is located in a vertical plane that bisects the rod the device is positioned on. It is most preferred that the center of mass of the device, or the center of mass of the device when filled or partially filled, be located below the rod since such design will tend to increase the stability of the device. Otherwise, the device may tend to rotate about the rod and possibly spill its contents, fall off, or otherwise become detached from the rod. In order to ensure that the center of mass of the device is in a vertical plane that bisects the rod, the device should be symmetrical about a plane that bisects the previously noted slots for receiving the support rod.

Regardless of the device design, it may be preferable to secure the device to the support rod, such as with fasteners. It is envisioned that the device may not require any securing to the support rod, especially if one or both discharge members 90, 100 are sufficiently long. That is, if material bin 200 disposed below support rod 240 and device 1 has sufficient interior clearance, one or both discharge members 90, 100 may extend into bin 200 such that movement of device 1 on or about rod 240 is limited as a result of contact between one or both members 90, 100 and bin 200. Alternatively, or in addition, extension walls 150 and 160 may extend into bin 200 sufficiently far enough, or be fashioned such that one or both walls 150 and 160 contact bin 200, such that movement of device 1 on or about rod 240 is limited.

Device 1 may be formed from a variety of materials including but not limited to plastic, metal, wood, and composites thereof. The material(s) selected for device 1 should be sufficiently rigid such that when particulate material is dispensed into the device, the device maintains its form and does not overly bend or deform under the increased weight of the particulate material. The preferred material for forming device 1 is fiberglass. It is also preferred to fashion the interior surfaces of device 1 to have relatively smooth, rounded corners to minimize resistance to flow of material through the device. The interior of the device may have a coating of a relatively hard material to minimize wear of the device as material flows through it. The exterior of device 1 may be coated with a protective material, resistive to the environment that the device will be utilized in.

Although the preferred embodiment has been described in conjunction with electroplating equipment, the present inventor envisions wide applicability in a variety of industries and applications. That is, the preferred embodiment device or variations thereof may be employed in agricultural, pharmaceutical, food processing and other industrial operations involving transfer or dispensing of flowable or particulate materials. Moreover, the preferred embodiment or variations thereof may be utilized for semi-solid, semi-liquid or liquid materials.

Of course, it is understood that the foregoing is merely a preferred embodiment of the invention and that various changes and alterations can be made without departing from the spirit and broader aspects thereof as set forth in the appended claims, which are to be interpreted in accordance with the principals of patent law including the Doctrine of Equivalents.

What is claimed is:

1. A material handling device comprising:

an upper region comprising a first upper sidewall, a second upper sidewall, and a pair of laterally spaced upper endwalls disposed between said first and said second upper sidewalls, said upper region defining a first opening for receiving flowable material; and at least two discharge members extending from said upper region in a direction opposite said first opening of said upper region, said discharge members each comprising a lower sloped sidewall and defining an opening facing said upper sidewall of an other discharge member wherein said members direct said material discharged from said upper region away from said device and into a single common stream.

2. A material handling device adapted for placement upon a generally horizontal support rod, said device comprising:

an upper region comprising a first upper sidewall, a second upper sidewall, and at least a pair of laterally spaced upper endwalls disposed between said first and said second upper sidewalls, said upper region defining a first opening for receiving particulate material;

a pair of discharge members extending from said upper region in a direction opposite said first opening of said upper region, wherein said members direct said particulate material discharged from said upper region away from said device;

wherein said device further defines at least one slot formed between said pair of discharge members, said slot having a width dimension and a length dimension sufficient to receive said support rod.

3. The material handling device of claim 2 wherein said first upper sidewall and said second upper sidewall are laterally spaced from one another and generally parallel.

4. The material handling device of claim 2 wherein each said discharge member comprises a first lower endwall joined to a portion of said upper region, a second lower endwall joined to a portion of said upper region, and a lower sidewall disposed between said first and said second lower endwalls and joined to said upper sidewall.

5. The material handling device of claim 4 wherein each of said discharge members has a U-shaped cross section as taken along a plane parallel to said first opening defined by said upper region.

6. The material handling device of claim 4 wherein a first medial sloped endwall is disposed between and contiguous with one of said upper endwalls and said first lower endwall of one of said discharge members.

7. The material handling device of claim 6 wherein said first medial sloped endwall is disposed between and contiguous with one of said upper endwalls and said first lower endwall of both said discharge members.

8. The material handling device of claim 7 wherein said first medial sloped endwall slopes toward the interior of the device at an angle of about 45° from vertical.

9. The material handling device of claim 6 wherein a second medial sloped endwall is disposed between and contiguous with the other of said upper endwall and said second lower endwall of the other of said discharge member.

10. The material handling device of claim 9 wherein said second medial sloped endwall is disposed between and contiguous with the other of said upper endwall and said second lower endwall of both said discharge members.

11. The material handling device of claim 10 wherein said second medial sloped endwall slopes toward the interior of the device at an angle of about 45° from vertical.

12. The material handling device of claim 4 wherein said lower sidewall of each said discharge member slopes inward at an angle of about 45° from vertical.

13. The material handling device of claim 2 wherein said device defines a first and a second slot for receiving said support rod.

14. The material handling device of claim 9 wherein said device further defines a first and a second slot formed between said discharge members, said first slot formed in a portion of said first medial sloped endwall and a portion of said first lower endwall, and said second slot formed in a portion of said second medial sloped endwall and a portion of said second lower endwall.

15. The material handling device of claim 2 wherein each said discharge member comprises an extension wall joined along the distal edge of said discharge member, and generally extending in a direction opposite said first opening of said upper region.

16. An assembly for reducing spillage of particulate material dispensed into a material bin suspended from a support rod, said assembly comprising:

a support rod secured to at least one mounting surface by a mounting means, said rod horizontally oriented;

at least one material bin having an upward facing opening for receiving particulate material dispensed therein, said material bin suspended from said rod by a suspending device; and a material handling device disposed over said rod and said material bin, said device supported by said rod, said device comprising an upper region formed by a pair of laterally spaced opposing upper sidewalls and a pair of laterally spaced opposing upper endwalls, said pair of upper sidewalls and said pair of upper endwalls defining an upward facing first opening for receiving said particulate material, and a pair of discharge members extending away from said first opening of said upper region toward at least a portion of said material bin, wherein said members direct said material discharged from said upper region and direct said material into said upward facing opening of said material bin.

17. The assembly of claim 16 wherein each said discharge member of said material handling device comprises a first lower endwall joined to a portion of said upper region, a second lower endwall joined to a portion of said upper region, and a lower sidewall disposed between said first and said second lower endwalls and joined to said upper sidewall.

18. The assembly of claim 17 wherein each of said discharge members has a U-shaped cross section as taken along a plane parallel to said upward facing first opening defined by said pair of upper sidewalls and said pair of upper endwalls.

19. The assembly of claim 17 wherein a first medial sloped endwall is disposed between and contiguous with one of said upper endwalls and said first lower endwall of one of said discharge members.

20. The assembly of claim 19 wherein said first medial sloped endwall slopes toward the interior of the device at an angle of about 45° from vertical.

21. The assembly of claim 19 wherein said suspending device is disposed generally underneath said first medial sloped endwall.

22. A method of reducing waste when filling a bin secured to a generally horizontal support rod, with a flowable material, said method comprising:

obtaining a material handling device comprising (1) an upper region having a first upper sidewall, a second upper sidewall, and at least a pair of laterally spaced upper endwalls disposed between said first and said second upper sidewalls, said upper region defining a first opening for receiving particulate material and (2) a pair of discharge members extending from said upper region in a direction opposite said first opening of said upper region, wherein said members direct said material discharged from said upper region away from said device, said device further defining at least one slot formed between said pair of discharge members, said slot having a width dimension and a length dimension sufficient to receive said support rod; and disposing said material handling device on said support rod such that said first opening is generally directed upward for receiving particulate material and said discharge members extend downward toward said bin.

23. The method of claim 22 further comprising:

positioning said material handling device on said support rod such that said rod is received by and extends through said at least one slot of said device, whereby said device is stabilized when positioned on said support rod.

24. A method of achieving and maintaining uniform spacing between two adjacent material bins suspended from a support rod, said method comprising:

obtaining two material handling devices, each defining an upwardly facing opening, and comprising (1) an upper region comprising a first upper sidewall, a second upper sidewall, and at least a pair of laterally spaced upper endwalls disposed between said first and said second upper sidewalls, wherein a pair of distal shoulders are formed on the ends of said device, (2) a pair of discharge members extending in a direction opposite said upwardly facing opening, and (3) at least one slot formed between said pair of discharge members, said slot having a width dimension and a length dimension sufficient to receive said support rod;

positioning a first of said two material handling devices on said support rod generally above a first of said two adjacent material bins; and positioning a second of said two material handling devices on said support rod generally above a second of said two adjacent material bins;

whereby at least one shoulder of said first material handling device and at least one shoulder of said second material handling device contact one another thereby achieving and maintaining uniform spacing between said adjacent material bins.

25. A method for reducing spillage of particulate material when dispensed into a material bin suspended from a generally horizontal support rod, said method comprising:

positioning a material handling device over said material bin and supported by said rod, said device comprising an upper region defining a first opening for receiving said particulate material, a pair of discharge members extending from said upper region in a direction opposite said first opening of said upper region, wherein said members direct said material from said upper region and into said material bin, and a slot formed between said pair of discharge members, said slot having a width dimension and a length dimension sufficient to receive said support rod.

* * * * *